US009447663B1

(12) United States Patent
Connell et al.

(10) Patent No.: US 9,447,663 B1
(45) **Date of Patent: *Sep. 20, 2016**

(54) ABRASIVE PERFORATOR WITH FLUID BYPASS

(71) Applicant: Thru Tubing Solutions, Inc., Oklahoma City, OK (US)

(72) Inventors: Michael L. Connell, Mustang, OK (US); Robert J. Farkas, Blanchard, OK (US)

(73) Assignee: THRU TUBING SOLUTIONS, INC., Oklahoma City, OK (US)

( * ) Notice: Subject to any disclaimer, the term of this patent is extended or adjusted under 35 U.S.C. 154(b) by 71 days.

This patent is subject to a terminal disclaimer.

(21) Appl. No.: 14/284,232

(22) Filed: May 21, 2014

Related U.S. Application Data

(63) Continuation of application No. 13/875,422, filed on May 2, 2013, now Pat. No. 8,905,125, which is a continuation of application No. 12/849,286, filed on Aug. 3, 2010, now Pat. No. 8,448,700.

(51) Int. Cl.
*E21B 43/11* (2006.01)
*E21B 29/00* (2006.01)
*E21B 43/114* (2006.01)

(52) U.S. Cl.
CPC ..... *E21B 43/114* (2013.01); *E21B 29/00* (2013.01)

(58) Field of Classification Search
CPC ..... E21B 43/114; E21B 7/18; E21B 34/14; E21B 2034/007
See application file for complete search history.

(56) References Cited

U.S. PATENT DOCUMENTS

| | | | | |
|---|---|---|---|---|
| 2,865,602 | A * | 12/1958 | Whittle | E21B 4/02 175/107 |
| 3,301,337 | A * | 1/1967 | Vaughn et al. | 175/22 |
| 4,815,540 | A * | 3/1989 | Wallbillich, III | 166/377 |
| 5,806,599 | A * | 9/1998 | Hisaw | E21B 23/01 166/105 |
| 6,189,618 | B1 * | 2/2001 | Beeman et al. | 166/312 |
| 6,732,793 | B1 * | 5/2004 | Lee | 166/222 |
| 7,383,881 | B2 * | 6/2008 | Telfer | E21B 17/1078 166/212 |
| 7,617,871 | B2 * | 11/2009 | Surjaatmadja et al. | 166/298 |
| 7,673,673 | B2 * | 3/2010 | Surjaatmadja et al. | 166/55 |
| 7,841,396 | B2 * | 11/2010 | Surjaatmadja | 166/177.5 |
| 7,963,331 | B2 * | 6/2011 | Surjaatmadja et al. | 166/285 |
| 8,066,059 | B2 * | 11/2011 | Ferguson et al. | 166/55.2 |
| 8,132,625 | B2 * | 3/2012 | Anderson | 166/318 |
| 8,210,250 | B2 * | 7/2012 | Ferguson et al. | 166/55.2 |
| 8,448,700 | B2 * | 5/2013 | Connell et al. | 166/55.2 |
| 8,550,176 | B2 * | 10/2013 | Knobloch, Jr. | E21B 21/103 166/334.1 |
| 8,905,125 | B1 * | 12/2014 | Connell et al. | 166/55.2 |
| 2006/0201675 | A1 * | 9/2006 | Ferguson et al. | 166/298 |
| 2006/0219441 | A1 * | 10/2006 | Telfer | E21B 17/1078 175/325.7 |
| 2006/0243455 | A1 * | 11/2006 | Telfer et al. | 166/386 |
| 2007/0284106 | A1 * | 12/2007 | Kalman et al. | 166/298 |
| 2008/0135248 | A1 * | 6/2008 | Talley et al. | 166/285 |

(Continued)

*Primary Examiner* — Jennifer H Gay
(74) *Attorney, Agent, or Firm* — Mary M. Lee

(57) ABSTRACT

An abrasive perforator tool with a bypass flow channel. The tool comprises a tubular body or housing with perforating nozzles in the sidewall. A sleeve assembly inside the central bore of the tool provides for sequential deployment of first and second sleeves. Prior to deployment of the sleeve assembly, pressurized fluid can be passed through the tool to operate other tools beneath the perforator in the bottom hole assembly. Deployment of the first sleeve diverts pressurized fluid through the nozzles for perforating. Deployment of the second sleeve redirects the pressurized flow through the outlet of the tool to resume operation of other tools below the perforator.

21 Claims, 9 Drawing Sheets

(56) References Cited

U.S. PATENT DOCUMENTS

2008/0283299 A1* 11/2008 Surjaatmadja ..... 175/67
2009/0016900 A1* 1/2009 Khomynets ..... F04F 5/464 417/172
2009/0032255 A1* 2/2009 Surjaatmadja et al. ..... 166/281
2009/0308588 A1* 12/2009 Howell et al. ..... 166/66.4
2011/0114316 A2* 5/2011 Ferguson et al. ..... 166/298
2012/0031615 A1* 2/2012 Connell et al. ..... 166/298
2012/0118577 A1* 5/2012 Trahan ..... E21B 21/103 166/311
2012/0152550 A1* 6/2012 East, Jr. ..... 166/308.1
2013/0248192 A1* 9/2013 Cook ..... 166/308.1
2014/0069648 A1* 3/2014 Dotson et al. ..... 166/298
2014/0102705 A1* 4/2014 Dotson ..... 166/298

* cited by examiner

ABRASIVE PERFORATOR WITH FLUID BYPASS

CROSS-REFERENCE TO RELATED APPLICATIONS

This application is a continuation of co-pending application Ser. No. 13/875,422, filed May 2, 2013, entitled Abrasive Perforator with Fluid Bypass, which is a continuation of Ser. No. 12/849,286, filed Aug. 3, 2010, entitled Abrasive Perforator with Fluid Bypass, now U.S. Pat. No. 8,448,700, issued May 28, 2013. The contents of these prior applications are incorporated herein by reference.

FIELD OF THE INVENTION

The present invention relates generally to downhole tools and, more particularly but without limitation, to abrasive perforating tools.

BACKGROUND OF THE INVENTION

Sand perforating operations on coiled tubing have proven to be a very effective alternative to explosive perforating. Recent innovations in abrasive perforating include the tool disclosed in U.S. patent application Ser. No. 11/372,527, entitled "Methods and Devices for One Trip Plugging and Perforating of Oil and Gas Wells," filed Mar. 9, 2006, and first published on Sep. 14, 2006, as U.S. Patent Application Publication No. 2006/0201675 A1. This tool has two positions—a neutral or running position and a deployed or perforating position. In the running position, the perforating nozzles are blocked by a sleeve, and pressurized fluid flows through the tool for operating other tools beneath it in the tool string. In the deployed or perforating position, a sleeve is shifted to open the flow path to the nozzles. While this tool represents a major improvement in abrasive perforating operations, it requires the operator to pull the tool string from the well to reset or remove the perforator in order to reestablish pressurized flow through the bottom hole assembly for subsequent well operations.

SUMMARY OF THE INVENTION

The present invention is directed to an abrasive perforator. The tool comprises a tubular tool housing comprising an inlet and an outlet and a sidewall extending therebetween. The sidewall of the housing defines a central bore extending between the inlet and the outlet. At least one nozzle is included in the sidewall. Also included is a first sleeve movable from a non-deployed position to a deployed position and a second sleeve movable from a non-deployed position to a deployed position after the first sleeve has been deployed. When the first and second sleeves are in the non-deployed position, fluid entering the inlet is directed entirely to the outlet through a first flow path. When the first sleeve is deployed and the second sleeve is not deployed, fluid entering the inlet is diverted entirely to the at least one nozzle through a second flow path. When the second sleeve is deployed, fluid entering the inlet is directed entirely to the outlet through a third flow path. The tool further comprises actuators for initiating sequential deployment of the first and second sleeves.

In another aspect, the present invention comprises a method for treating a well. A tool string is run down the well, the tool string comprising an abrasive perforating tool. Fluid is passed through the tool string without perforating. After passing fluid through the tool string without perforating, the well is abrasively perforated without withdrawing the tool string. After abrasively perforating the well, fluid is passed through the tool string without perforating and without withdrawing the tool string.

DETAILED DESCRIPTION OF THE PREFERRED EMBODIMENT(S)

The present invention comprises a further innovation in abrasive perforating by providing a tool in which pressurized flow can be reestablished without removing the tool from the well. Thus, this perforator allows the operation of other fluid driven tools below it in the bottom hole assembly after perforating and without removing the tool string from the well. For example, a motor or wash nozzle can be included in the bottom hole assembly below the perforator and used immediately after the perforating operation is completed.

Figure 1:
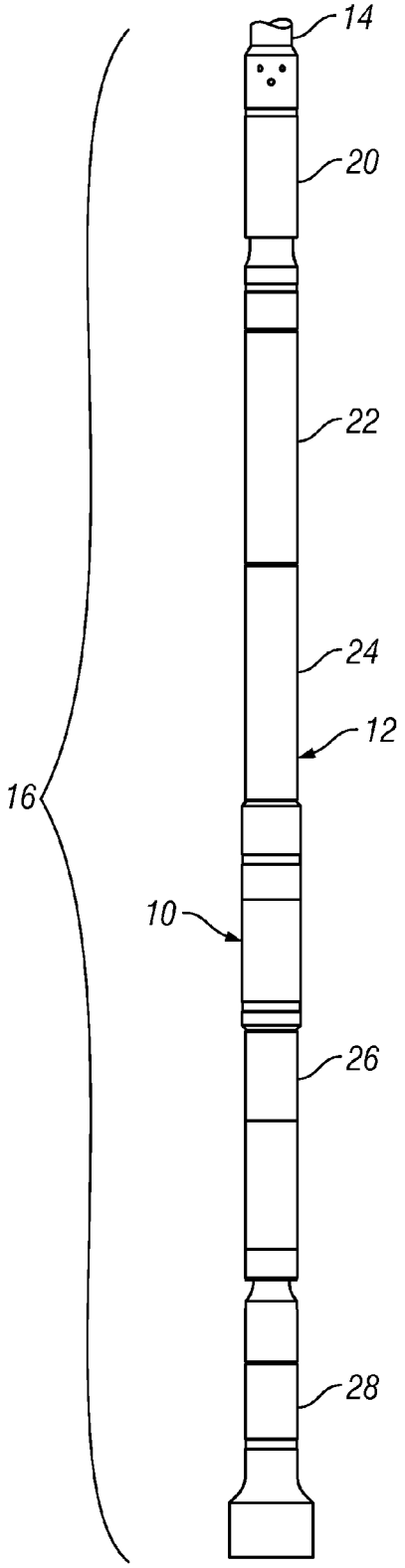
FIG. 1 is a fragmented side elevational view of a drill string comprising a bottom hole assembly including an abrasive perforator tool made in accordance with the present invention.

Turning now to the drawings in general and to FIG. 1 in particular there is shown therein an abrasive perforating tool designated generally by the reference number 10. The tool 10 is shown as one of several components in a bottom hole assembly ("BHA") 12 suspended at the end of a conduit 14, such as coiled tubing. As used herein, "bottom hole assembly" or simply "BHA," refers to the combination of tools supported on the end of the well conduit 14. As used herein, "drill string" refers to the column or string of drill pipe, coil tubing, wireline, or other well conduit 14, combined with attached bottom hole assembly 12, and is designated herein generally by the reference number 16.

The BHA 12 may include a variety of tools. In the example shown, the BHA 12 includes a coiled tubing connector 20, a dual back pressure valve 22, a hydraulic disconnect 24, the inventive bypass perforator tool 10, a motor 26, and a mill 28 on the end.

Figure 2:
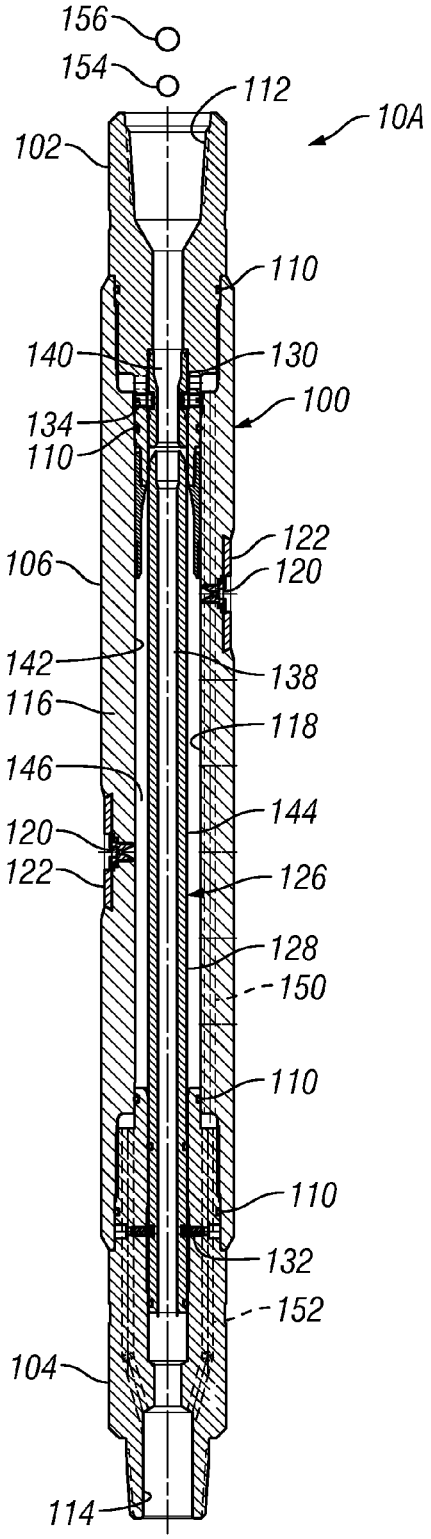
FIG. 2 shows a longitudinal sectional view of an abrasive perforator tool made in accordance with a first preferred embodiment of the present invention.

With reference now to FIG. 2, a first preferred embodiment of the tool 10A will be described. The tool 10A comprises a tubular tool housing designated generally at 100. Preferably the housing 100 is made up of a top sub 102, a bottom sub 104, and a housing body 106, that are threadedly interconnected with seals, such as O-rings, designated generally at 110 to provide a fluid tight passage therethrough. The top sub 102 defines an inlet 112, the bottom sub 104 defines an outlet 114, and the body 106 comprises a sidewall 116 that defines a central bore 118 that extends between the inlet and the outlet.

At least one and preferably several nozzles 120 are supported in the sidewall 116 of the housing 100. These nozzles may take many forms. The nozzles may be commercially available carbide nozzles that are threaded into nozzle bores. The nozzles may be provided with abrasion resistant plates or collars 122.

A sleeve assembly 126 is supported inside the central bore 116. The sleeve assembly 126 comprises a first sleeve 128 and a second sleeve 130. The first sleeve is sized for sliding movement within the bore 118 from a non-deployed position to a deployed position, but in the neutral or non-deployed position shown in FIG. 2, the first sleeve 128 is detachably fixed in a non-deployed position by shear pins 132, which may be located in the bottom sub 104. Similarly, the second sleeve 130 is sized for sliding movement within the bore 118 from a non-deployed position to a deployed position, but in the neutral or non-deployed position shown in FIG. 2, the second sleeve 130 is detachably fixed in a non-deployed position by shear pins 134, which may be located in the lower end of the top sub 102. Thus, the first and second sleeves 128 and 130 are arranged in end-to-end fashion along the bore 118 of the housing body 106.

In this embodiment, the lumen 138 of the first sleeve 128 defines a portion of a first flow path and the lumen 140 of the second sleeve 130 connects the inlet 112 to the first sleeve 128, and thus also forms a part of the first flow path. The lower end of the first sleeve 128 opens into the outlet 114 of the bottom sub 104. Thus, when both sleeves 128 and 130 are in the non-deployed position, fluid entering the inlet 112 is directed entirely to the outlet 114.

The lumen 142 of the housing body 106 and the outer surface 144 of the first sleeve 128 define an annular chamber 146 around the first sleeve that is continuous with the nozzles 120 and thus partly defines a second flow path, which will be explained in more detail hereafter.

Referring still to FIG. 2, the sidewall 116 of the housing body defines longitudinal flow channels 150 that at least partly define a third flow path, which will be explained in more detail hereafter. The bottom sub 104 may contain longitudinal flow paths 152 that are fluidly connected to the flow channels 150 in the housing sidewall 116.

Actuators, such as the balls 154 and 156, are included to initiate the sequential deployment of the first and second sleeves. This procedure is described below. Alternately, other types of actuators could be used, such as darts and plugs.

Figure 3A:
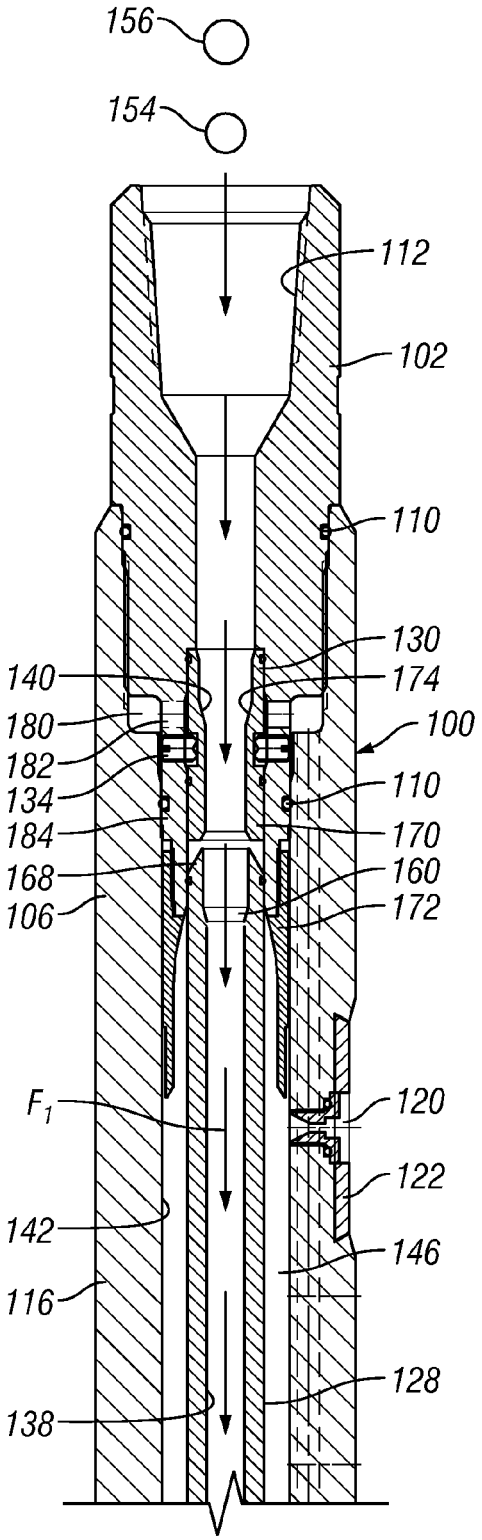
FIGS. 3A-3B show sequential longitudinal sectional views of the abrasive perforator tool of FIG. 2 in the neutral or running position.
Figure 3B:
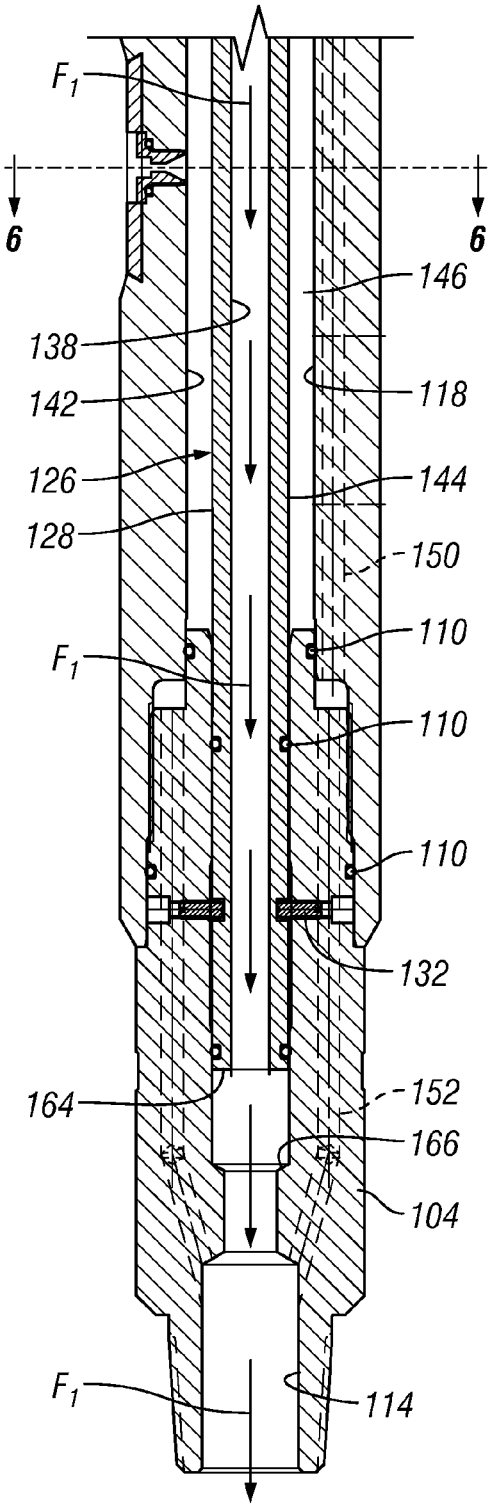

FIGS. 3A and 3B show the tool 10A in the non-deployed or neutral position. As indicated, in this position, neither of the sleeves 128 or 130 is deployed and together with the inlet 112 in the top sub 102 and outlet 114 in the bottom sub 104, they form a first flow path designated in these figures by the arrows at $F_1$. All fluid entering the inlet 112 is directed to the outlet 114.

Figure 4A:
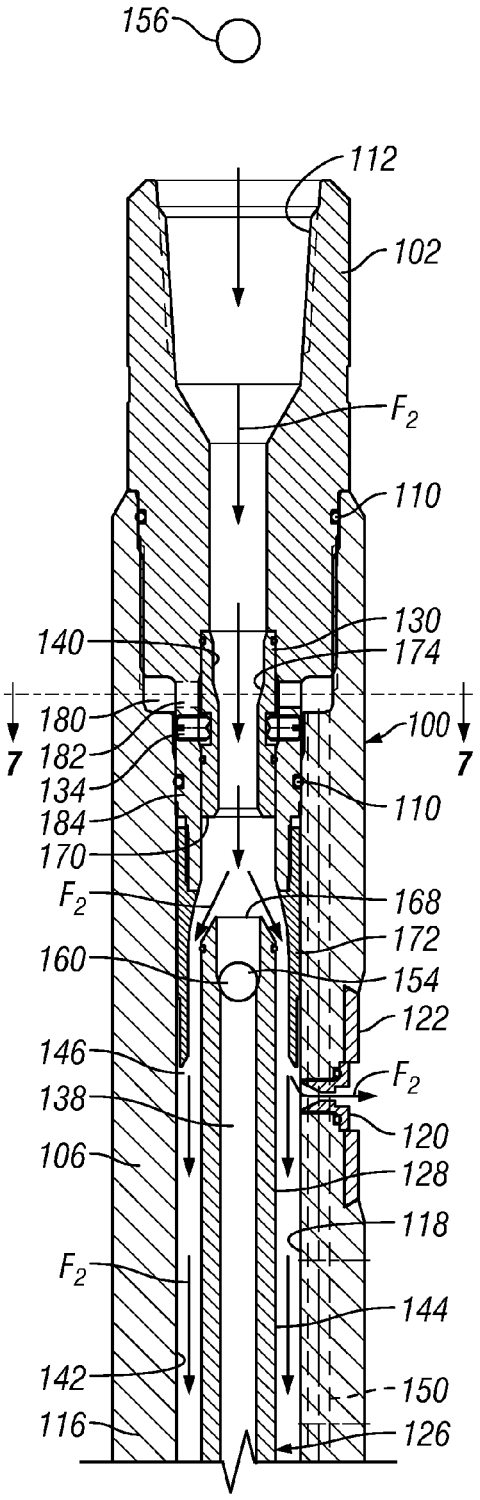
FIGS. 4A-4B show sequential longitudinal sectional views of the abrasive perforator tool of FIG. 2, in the first deployed position.
Figure 4B:
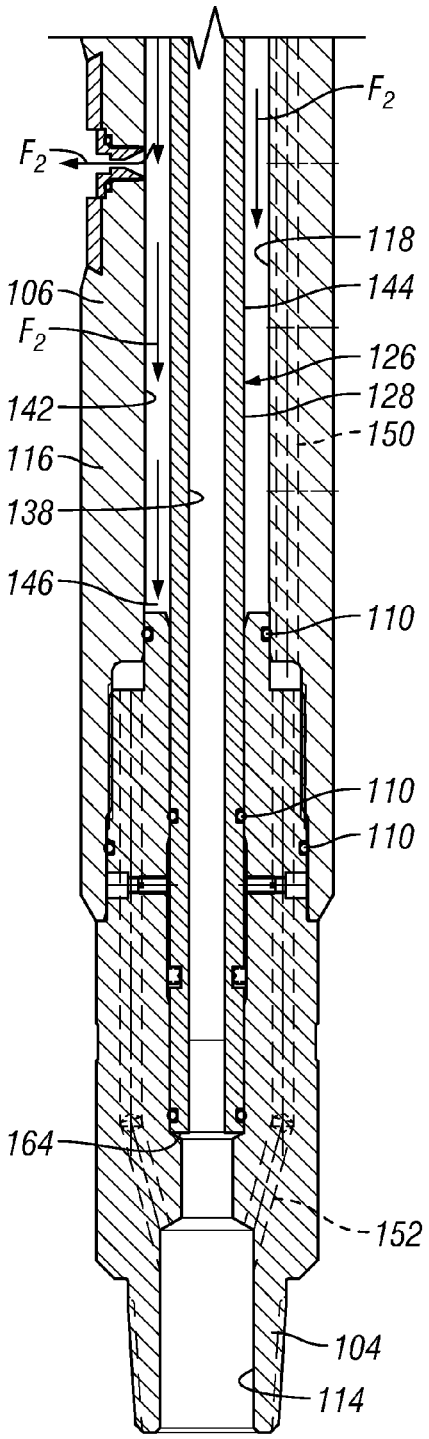

Turning now to FIGS. 4A and 4B, the perforating step is initiated by dropping the first ball 154. When it seats in the seat 160 (see also FIG. 3A) formed in the upper end of the first sleeve 128, flow through the lumen 138 of the first sleeve is blocked and fluid pressure rises. Preferably, the first ball 154 is ceramic to better withstand the abrasive effect of the perforating fluid. Once the fluid pressure exceeds the shear strength of the shear pins 132 (FIG. 3B), the shear pins break and the sleeve 128 shifts downwardly until the bottom end 164 of the first sleeve engages the shoulder 166 formed in the outlet 114 of the bottom sub 104. See also FIG. 3B.

Figure 6:
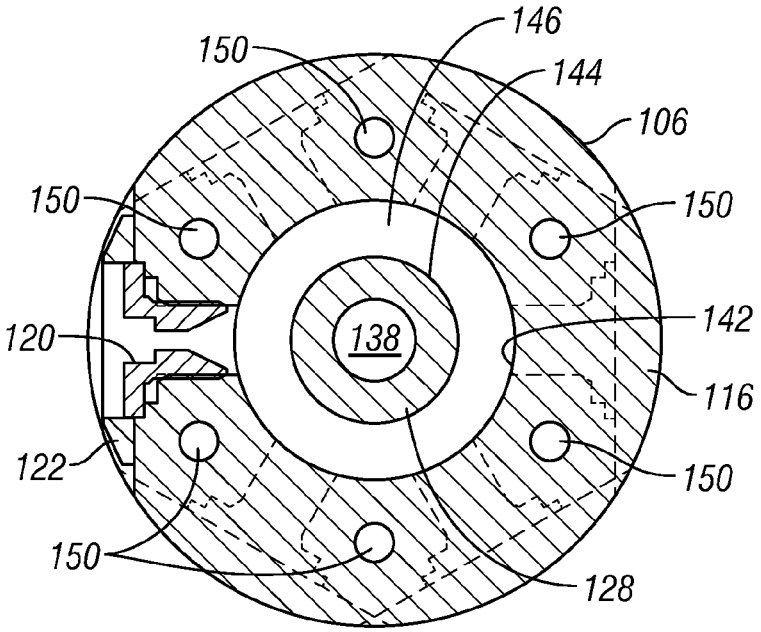
FIG. 6 is a cross-sectional view of the abrasive perforator tool of FIG. 2 taken along line 6-6 in FIG. 3B.

As best seen in FIG. 4A, the downward movement of the first sleeve 128 separates the upper end 168 of the first sleeve from the bottom end 170 of the second sleeve 130. At the same time, flow through the first sleeve 128 is blocked by the ball 154. This diverts the flow of fluid into the annular chamber 146 and out the nozzles 120 along the second flow path identified by the arrows designated at $F_2$. See also FIG. 6. Because sand or other abrasives are usually added to the fluid at this point, the fluid at this location may cause rapid wear. Thus, a wear funnel 172 may be included on the end of the top sub 102 to streamline the fluid flow and protect the sidewall 116 from excessive wear.

Figure 5A:
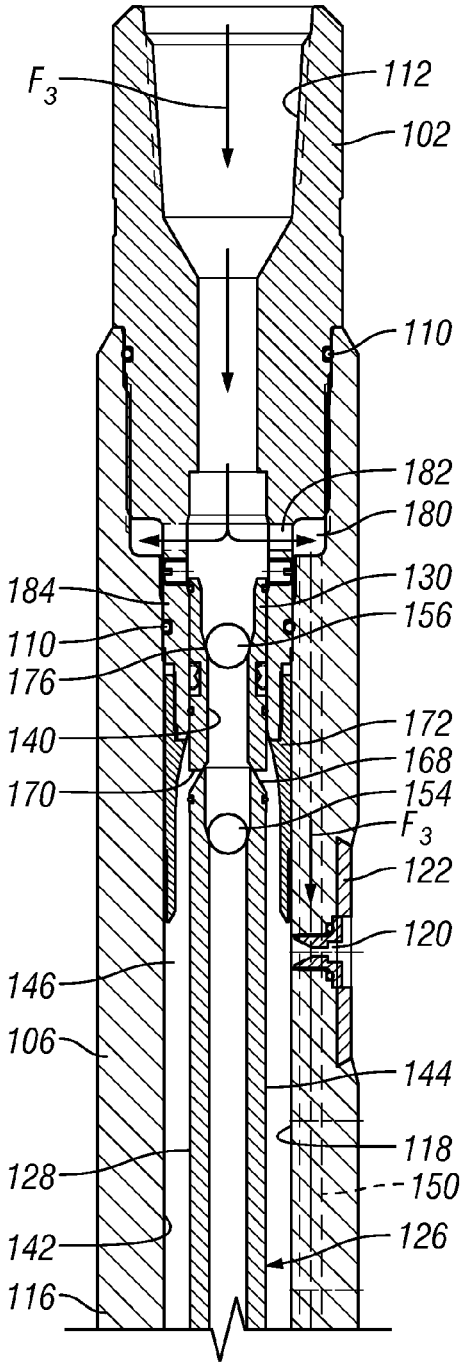
FIGS. 5A-5B show sequential longitudinal sectional views of the abrasive perforator tool of FIG. 2 in the second deployed position.
Figure 5B:
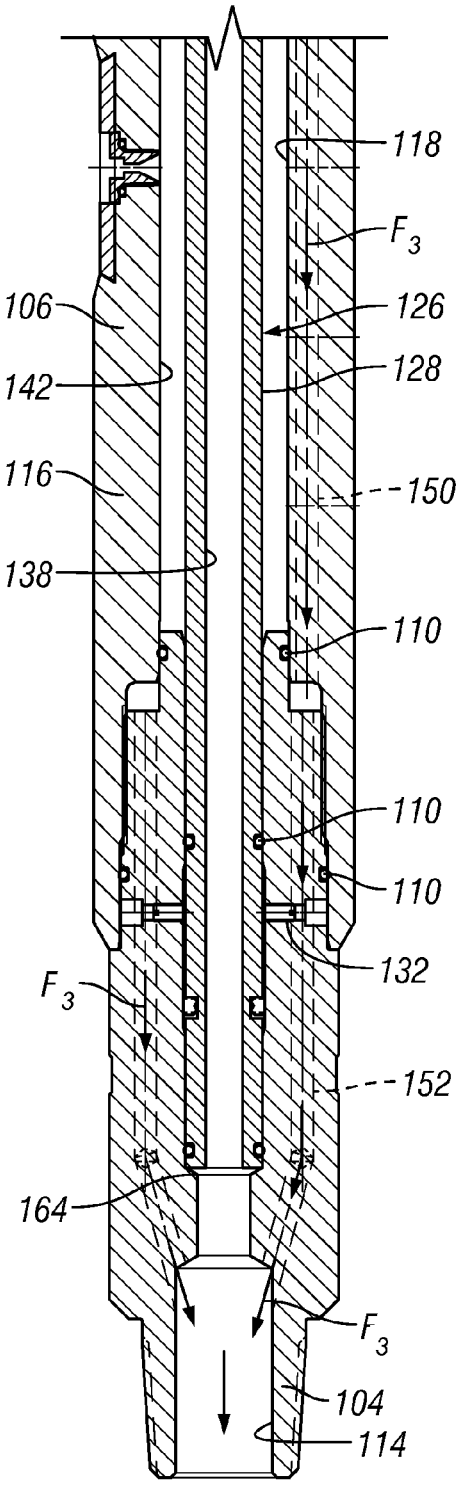

Once the perforating operation has been completed, flow can be reestablished through the tool bypassing the nozzles. This is accomplished by dropping the second ball 156, which seats in the ball seat 174, as shown in FIGS. 5A and 5B. See also FIGS. 3A and 4A. The second ball may be steel. Once the fluid pressure exceeds the pressure necessary to break the shear pins 134 (FIGS. 3A & 4A), the second sleeve 130 shifts downwardly until its bottom end 170 engages the upper end 168 of the first sleeve 128. This blocks passage of fluid into the annular chamber 146.

Figure 7:
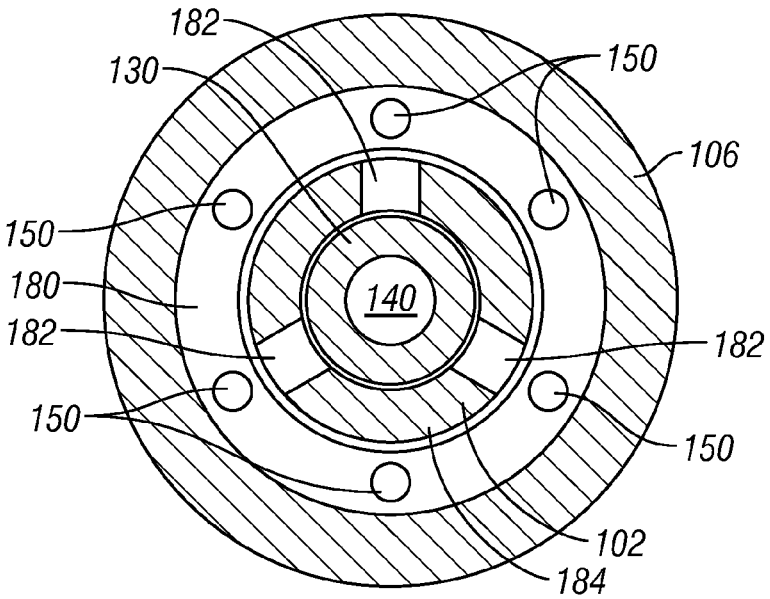
FIG. 7 is a cross-sectional view of the abrasive perforator tool of FIG. 2 taken along line 7-7 in FIG. 4A.

The top sub 102 and the housing body 106 are formed so that there is an annular space 180 surrounding the second sleeve 130 when it is undeployed. This space 180, along with transverse ports 182 through the neck 184 of the top sub 102, fluidly connect the inlet 112 with the longitudinal channels 150 in the sidewall 116 of the housing body 106. See also FIG. 7. Thus, fluid entering the inlet 112 is diverted into the longitudinal channels 150 along the third flow path indicated by the arrows identified as $F_3$.

Figure 8:
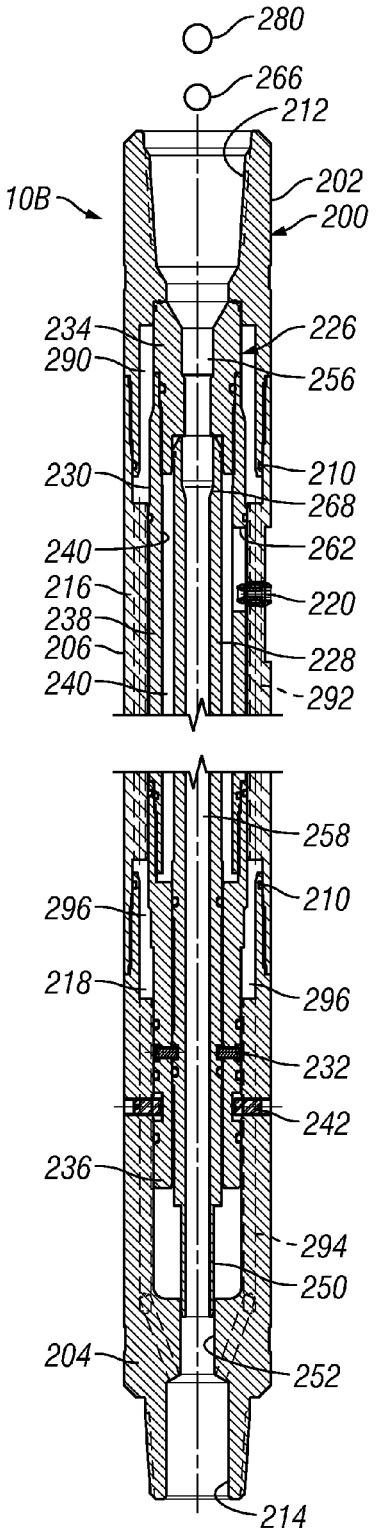
FIG. 8 shows a fragmented, longitudinal sectional view of an abrasive perforator tool made in accordance with a second preferred embodiment of the present invention.

Turning now to FIG. 8, there is shown therein a second preferred embodiment of the abrasive perforator tool of the present invention designated generally by the reference number 10B. The tool 10B comprises a tubular tool housing designated generally at 200. Preferably the housing 200 is made up of a top sub 202, a bottom sub 204, and a housing body 206, that are threadedly interconnected with seals, such as O-rings, designated generally at 210 to provide a fluid tight passage therethrough. The top sub 202 defines an inlet 212, the bottom sub 204 defines an outlet 214, and the body 206 comprises a sidewall 216 that defines a central bore 218 that extends between the inlet and the outlet.

Figure 9A:
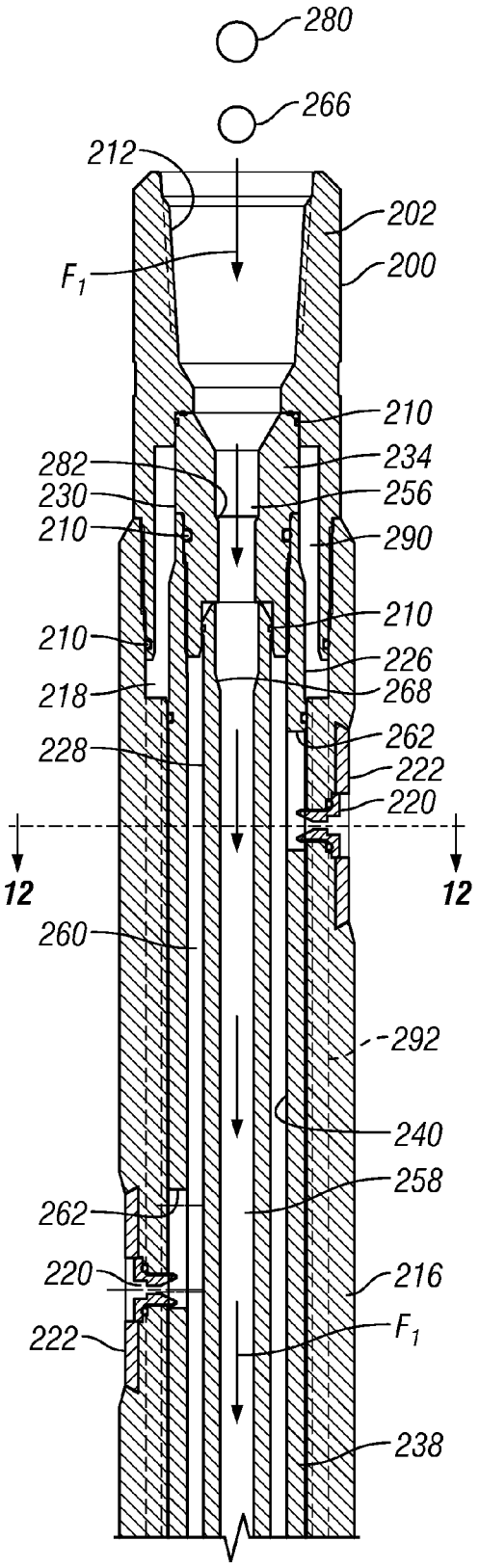
FIGS. 9A-9B show sequential longitudinal sectional views of the abrasive perforator tool of FIG. 8 in the neutral or running position.

At least one and preferably several nozzles 220 are supported in the sidewall 216 of the housing 200. These nozzles may take many forms. The nozzles may be commercially available carbide nozzles that are threaded into nozzle bores. The nozzles may be provided with abrasion resistant plates or collars 222 (FIG. 9A).

A sleeve assembly 226 is supported inside the central bore 216. The sleeve assembly 226 comprises a first sleeve 228 and a second sleeve 230. The first sleeve 228 is sized for sliding movement within the bore 218 from a non-deployed position to a deployed position, but in the neutral or non-deployed position shown in FIG. 8 and also in FIGS. 9*a* and 9B, the first sleeve 228 is detachably fixed by shear pins 232 in the second sleeve 230.

In this embodiment, the second sleeve 230 preferably comprises an upper end member 234, a lower end member 236, and a sleeve body 238 extending therebetween defining a lumen 240. The second sleeve 230 is also sized for sliding movement within the bore 218 from a non-deployed position to a deployed position, but in the neutral or non-deployed position shown in FIGS. 8, 9A and 9B, the second sleeve 230 is detachably fixed in a non-deployed position by shear pins 242, which may be located in the lower end member 236 and the bottom sub 204.

Figure 9B:
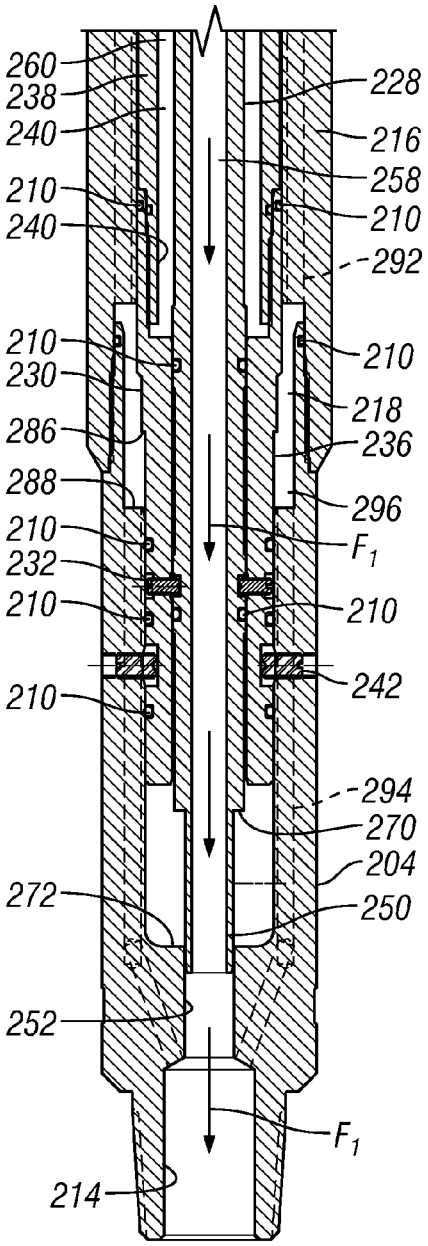

The upper end of the upper end member 234 of the second sleeve 230 is slidably received in an enlarged diameter portion 246 (FIG. 11A), and the upper end of the first sleeve 228 is slidably received in an enlarged diameter portion 248 (FIG. 10A) of the second sleeve. The lower end 250 of the first sleeve 230 is slidably received in a narrow diameter portion 252 (FIGS. 8 & 9B) formed in the bottom sub 204. In this way, when neither of the first and second sleeves 228 and 230 is deployed, the lumen 256 of the upper end member 234 of the second sleeve and the lumen 258 of the first sleeve together with the inlet 212 and the outlet 214 define a first flow path designated by the arrows at $F_1$ (FIGS. 9A & 9B). In this position, pressurized fluid may be passed through tool 10B without operating the nozzles; that is, all the fluid entering the inlet 212 is directed to the outlet 214 through the first flow path $F_1$.

Now it will be seen that in this embodiment, the first and second sleeves 228 and 230 are arranged concentrically in the central bore 218 of the housing 200. The first and second sleeves 228 and 230 are sized so that the outer surface of the sidewall of the first sleeve and the lumen 240 of the second sleeve define an annular chamber 260. The second sleeve 230 is slidably received inside the housing body 206 with a relatively close tolerance therebetween and sealed with O-rings 210. Ports 262 in the second sleeve 230 are positioned to allow fluid to pass from the annular chamber 260 to the nozzles 220.

Figure 10A:
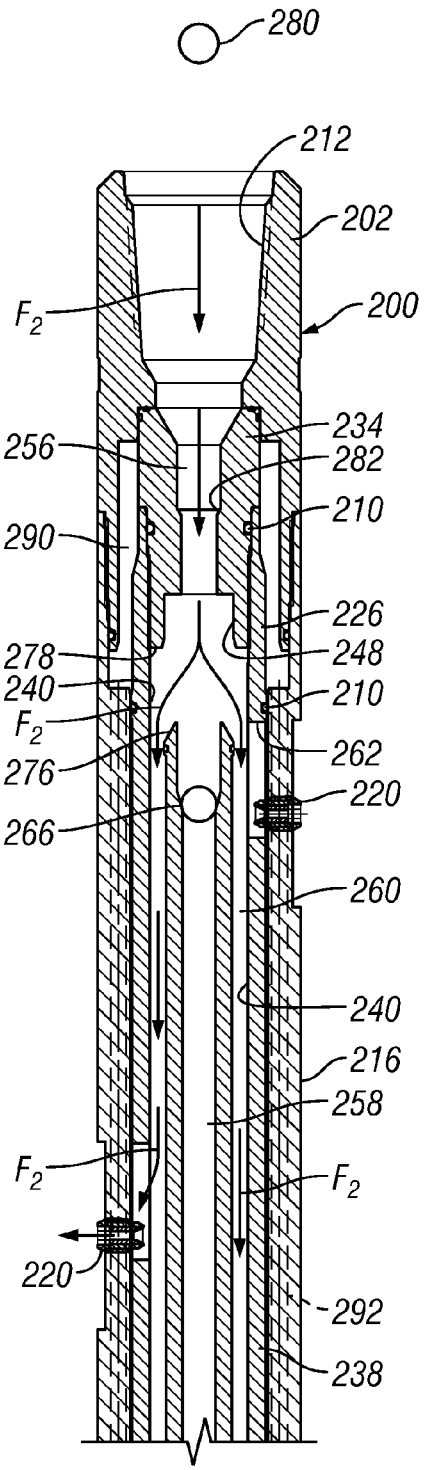
FIGS. 10A-10B show sequential longitudinal sectional views of the abrasive perforator tool of FIG. 8 in the first deployed position.
Figure 10B:
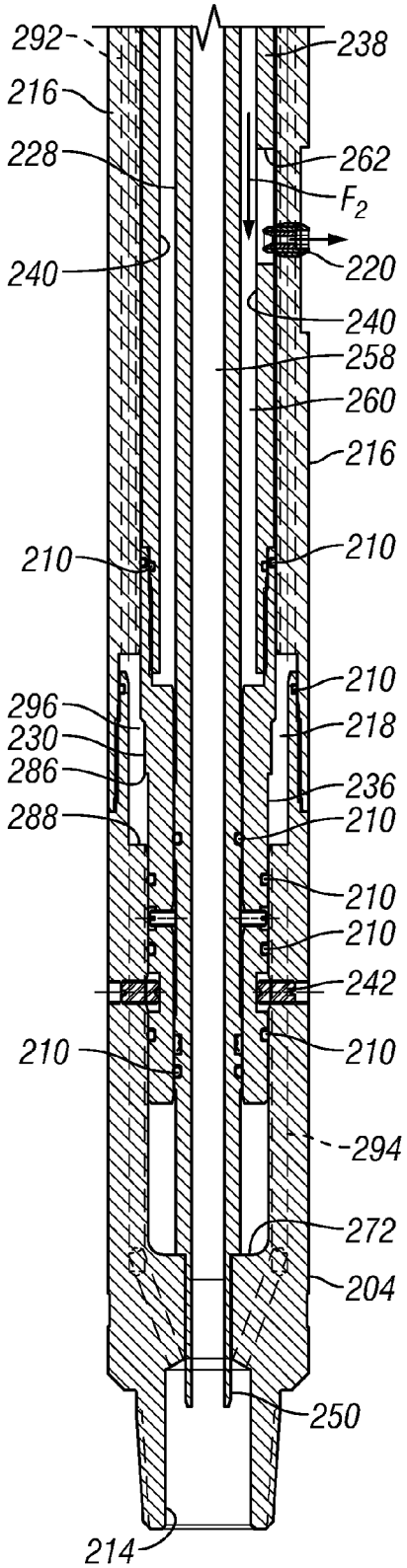

Turning now to FIGS. 10A and 10B, the perforating step is initiated by dropping the first ball 266. When it seats in the seat 268 (see also FIG. 3A) formed in the upper end of the first sleeve 228, flow through the lumen 258 of the first sleeve is blocked and fluid pressure rises. Once the fluid pressure exceeds the shear strength of the shear pins 232 (FIG. 9B), the shear pins break and the sleeve 228 shifts downwardly until the annular shoulder 270 on the first sleeve engages the shoulder 272 formed in the outlet 214 of the bottom sub 204, as best seen in FIG. 9B.

Figure 12:
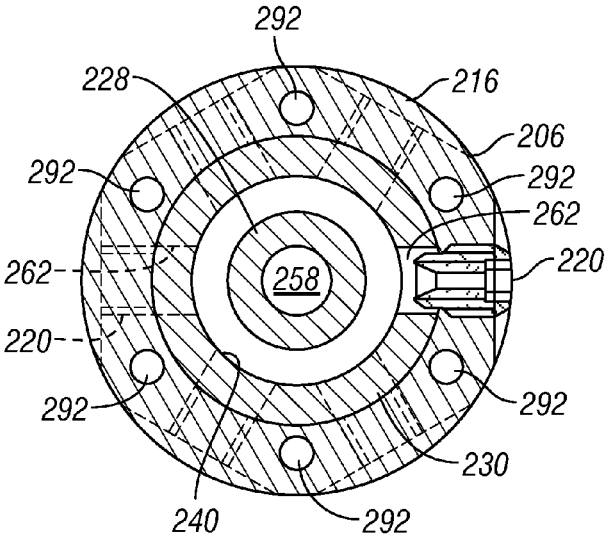
FIG. 12 is a cross-sectional view of the abrasive perforator tool of FIG. 8 taken along line 12-12 in FIG. 9A.

As best seen in FIG. 10A, the downward movement of the first sleeve 228 separates the upper end 276 of the first sleeve from the bottom end 278 of the upper end member 234 of the second sleeve 230. At the same time, flow through the first sleeve 228 is blocked by the ball 266. This diverts the flow of fluid into the annular chamber 260 along the second flow path identified by the arrows designated at $F_2$. The upper end 276 of the first sleeve 228 may be tapered to provide less resistance to the flow of fluid into the chamber 260. Because of the ports 262 in the second sleeve 230, the fluid in the annular chamber 260 is directed entirely to the nozzles 220. See also FIG. 12.

Figure 11A:
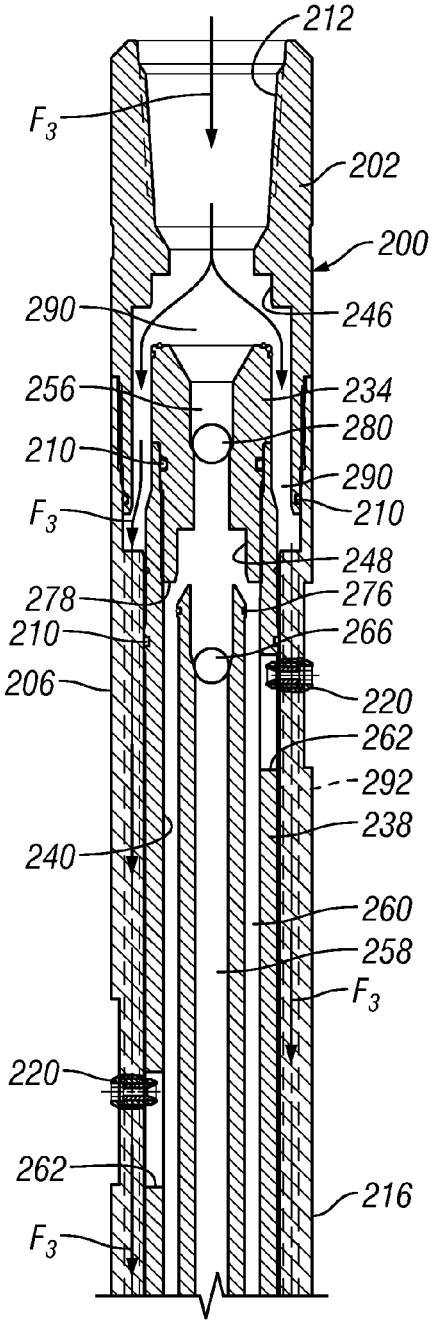
FIGS. 11A-11B show sequential longitudinal sectional views of the abrasive perforator tool of FIG. 8 in the second deployed position.
Figure 11B:
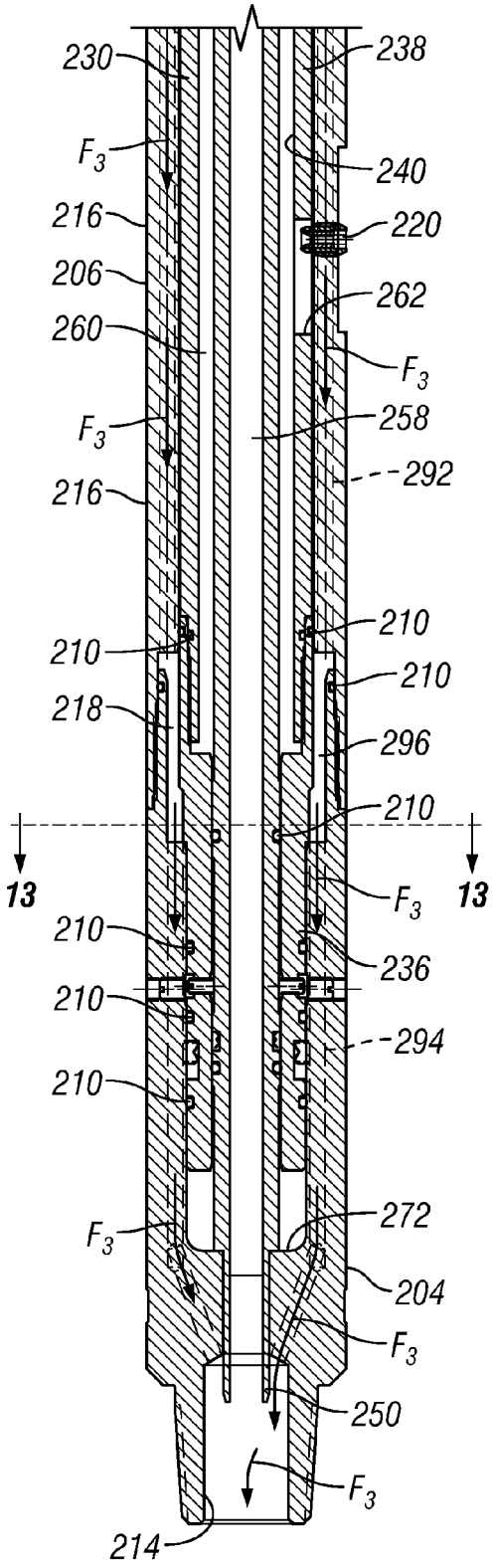

Once the perforating operation has been completed, flow can be reestablished through the tool 10B bypassing the nozzles 220, as shown in FIGS. 11A and 11B. This is accomplished by dropping the second ball 280, which seats in the ball seat 282, seen best in FIGS. 9A and 10A. Once the fluid pressure exceeds the pressure necessary to break the shear pins 242 (FIGS. 9B & 10B), the second sleeve 230 shifts downwardly until the annular shoulder 286 (FIGS. 9B & 10B) on the sleeve engages the annular shoulder 288 (FIGS. 9B & 10B) of the bottom sub 206, as shown in FIG. 11B. This causes the upper end member 234 to shift downward out of the enlarged diameter portion 246 of the top sub 202, allowing fluid to flow into an annular space 290 formed between the top sub and the outer diameter of the upper end member.

Figure 13:
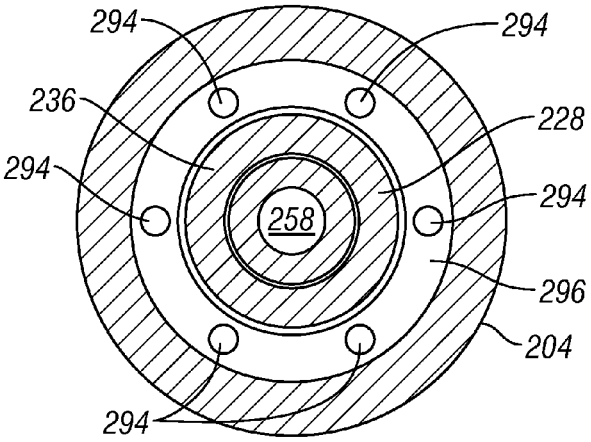
FIG. 13 is a cross-sectional view of the abrasive perforator tool of FIG. 8 taken along line 13-13 in FIG. 11B.

As shown in FIG. 11A, the space 290 fluidly connects the inlet 212 with longitudinal flow channels 292 formed in the sidewall 216 of the housing 206. Longitudinal flow channels 294 are also formed in the bottom sub 204. As shown in FIG. 11B, an enlarged diameter portion in the lower end of the housing 206 and the adjacent upper end of the bottom sub 204 creates another annular space 296 allowing fluid to flow from the channels 292 in the housing 206 to the channels 294 in the bottom sub 204 and then out the outlet 214. See also FIG. 13. Thus, the inlet 212, the upper annular space 290, the longitudinal flow channels 292 in the housing body 206, the lower annular space 296, and the longitudinal flow channels 294 in the bottom sub 204, together form the third flow path indicated by the arrows identified as $F_3$ in FIGS. 11A and 11B.

In both embodiments shown herein, the third or nozzle bypass flow path is created by having longitudinal channels formed in the sidewall of the tool's housing body and bottom sub. In the embodiments shown, these channels are formed in solid tubular steel using a gun drill. However, other techniques may be used to form these channels. Additionally, channels can be formed by using a "tube inside a tube" configuration for the housing, that is, by forming the housing out of closely fitting inner and outer tubular members, and forming longitudinal grooves in the outer diameter of the inner tubular member or in the inner diameter of the outer tubular member or both. These and other structures and methods for providing the peripheral longitudinal channels in the tool are intended to be encompassed by the present invention.

Now it will be apparent that the abrasive perforating tool of the present invention provides many advantages. One advantage is the ability to regain high-rate fluid flow through the tool after perforating. This allows a thorough cleanout of the well, which is difficult to obtain using current technology. Another advantage is the ability to operate a motor or other fluid driven tool below the perforating tool after completing the perforating operation but without withdrawing the tool string.

Thus, the invention further comprises a method for treating a well. The method comprises first running a tool string down the well. The tool string comprises a conduit and a bottom hole assembly that includes an abrasive perforating tool. Once the bottom hole assembly has been positioned at the desired depth, fluid is passed through the tool string without perforating. The above-described perforating tool allows pressurized fluid flow prior to perforating to carry out other well procedures, or to operate other fluid driven tool beneath the perforator in the bottom hole assembly, or both.

At the desired point in the well treatment process, that is, after passing fluid through the tool string without perforating, the well is abrasively perforated without withdrawing the tool string. This may be accomplished by dropping the first ball in the preferred perforating tool to divert fluid to the nozzles and changing the fluid to comprise an abrasive fluid.

After the perforating process is completed, the abrasive fluid is stopped and another suitable well treatment fluid continues to be passed through the tool string again after perforating and without withdrawing the tool string. This is accomplished by dropping the second ball in the above-described perforator to bypass the nozzles and resume flowing fluid through the outlet of the tool. Again, the above-described perforating tool allows pressurized fluid flow after perforating to carry out additional well procedures, or to operate other fluid driven tools beneath the perforator in the bottom hole assembly, or both.

As used herein, the terms "up," "upward," "upper," and "uphole," and similar terms refer only generally to the end of the drill string nearest the surface. Similarly, "down," "downward," "lower," and "downhole" refer only generally to the end of the drill string furthest from the well head. These terms are not limited to strictly vertical dimensions. Indeed, many applications for the tool of the present invention include non-vertical well applications.

The contents of U.S. Pat. No. 8,066,059, entitled "Methods and Devices for One Trip Plugging and Perforating of Oil and Gas Wells," issued on Nov. 29, 2011, and U.S. Patent Application Publication No. 2006/0201675 A1 entitled "Methods and Devices for One Trip Plugging and Perforating of Oil and Gas Wells," published on May 19, 2011, are incorporated herein by reference.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts, within the principles of the invention to the full extent indicated by the broad meaning of the terms. The description and drawings of the specific embodiments herein do not point out what an infringement of this patent would be, but rather provide an example of how to use and make the invention. Likewise, the abstract is neither intended to define the invention, which is measured by the claims, nor is it intended to be limiting as to the scope of the invention in any way. Rather, the limits of the invention and the bounds of the patent protection are measured by and defined in the following claims.

What is claimed is:

1. An abrasive perforator tool comprising:

a tubular tool housing comprising an inlet and an outlet and a sidewall extending therebetween, the sidewall defining a central bore extending between the inlet and the outlet;

at least one nozzle in the sidewall;

a sleeve assembly supported in the tool housing and operable to provide a first flow path, a second flow path, and a third flow path, wherein the sleeve assembly comprises first and second sleeves, and wherein the first and second sleeves are arranged end to end in the central bore of the housing;

wherein the first flow path directs fluid entering the inlet of the housing to bypass the at least one nozzle and to pass through the tool to the outlet of the housing;

wherein the second flow path directs fluid entering the inlet of the housing to pass through the at least one nozzle;

wherein the third flow path directs fluid entering the inlet of the housing to bypass the at least one nozzle and to pass through the tool to the outlet of the housing; and actuators for initiating operation of the sleeve assembly.

2. The abrasive perforator tool of claim 1 wherein each of the first and second sleeves has an inlet end that defines a ball seat and wherein the actuators are balls.

3. The abrasive perforator tool of claim 2 wherein the second sleeve defines a lumen and wherein the first flow path is defined in part by the lumen of the second sleeve.

4. The abrasive perforator tool of claim 1 wherein the first sleeve defines a lumen, and wherein the first flow path is defined in part by the lumen of the first sleeve.

5. The abrasive perforator tool of claim 1 wherein the second sleeve defines a lumen, and wherein the first flow path is defined in part by the lumen of the second sleeve.

6. The abrasive perforator tool of claim 1 wherein the first sleeve comprises a sidewall with an outer surface and wherein the second flow path is defined in part by the outer surface of the first sleeve's sidewall.

7. The abrasive perforator tool of claim 6 wherein the second sleeve defines a lumen, wherein the lumen of the second sleeve and the outer surface of the sidewall of the first sleeve define an annular chamber around the first sleeve that partly defines the second flow path to the nozzles, the second sleeve having ports for permitting fluid to flow from the annular chamber through the nozzles.

8. The abrasive perforator tool of claim 6 wherein the housing has a lumen, wherein the lumen of the housing and the outer surface of the sidewall of the first sleeve define an annular space around the first sleeve that partly defines the second flow path to the nozzles.

9. The abrasive perforator tool of claim 1 wherein the sidewall of the housing defines longitudinal flow channels that partly define the third flow path.

10. The abrasive perforator tool of claim 1 wherein each of the first and second sleeves is movable from a non-deployed position to a deployed position, and wherein the first and second sleeves are maintained in the nondeployed positions by shear pins.

11. The abrasive perforator tool of claim 1 wherein the first and second sleeves are arranged concentrically in the central bore of the housing.

12. The abrasive perforator tool of claim 1 wherein each of the first and second sleeves is movable from a non-deployed position to a deployed position, wherein the first sleeve comprises an upper end member and a lower end member and a sleeve body therebetween, wherein the second sleeve comprises an upper end member and a lower end member and a sleeve body therebetween, wherein the lower end member of the second sleeve is detachably fixed to the housing, wherein the upper end member of the second sleeve includes a recess for receiving the upper end of the first sleeve when the first sleeve is undeployed to direct fluid from the inlet through the first sleeve, and wherein the first sleeve is positioned concentrically within the sleeve body forming an annular chamber that fluidly connects the inlet to the at least one nozzle when the first sleeve is deployed and the second sleeve is undeployed, the second sleeve having ports therein for allowing fluid to pass from the annular chamber to the at least one nozzle.

13. The abrasive perforator tool of claim 12 wherein, when the second sleeve is deployed, the upper member shifts downwardly to allow fluid from the inlet to flow into the third flow path to the outlet.

14. The abrasive perforator tool of claim 13 wherein the tubular housing comprises a top sub, a bottom sub and a housing body therebetween, wherein the housing body and the bottom sub define longitudinal flow channels that partly define the third flow path.

15. The abrasive perforator tool of claim 1 wherein the tubular housing comprises a top sub, a bottom sub and a housing body therebetween, wherein the housing body and the bottom sub define longitudinal flow channels that partly define the third flow path.

16. A bottom hole assembly comprising the abrasive perforator tool of claim 1.

17. A tool string comprising the bottom hole assembly of claim 16.

18. An abrasive perforator tool comprising:

a tubular tool housing comprising an inlet and an outlet and a sidewall extending therebetween, the sidewall defining a central bore extending between the inlet and the outlet;

at least one nozzle in the sidewall;

a sleeve assembly supported in the tool housing and operable to provide a first flow path, a second flow path, and a third flow path;

actuators for initiating operation of the sleeve assembly, wherein the actuators are balls;

wherein the sleeve assembly comprises first and second sleeves, wherein each of the first and second sleeves has an inlet end that defines a ball seat;

wherein the first flow path directs fluid entering the inlet of the housing to bypass the at least one nozzle and to pass through the tool to the outlet of the housing;

wherein the second flow path directs fluid entering the inlet of the housing to pass through the at least one nozzle; and wherein the third flow path directs fluid entering the inlet of the housing to bypass the at least one nozzle and to pass through the tool to the outlet of the housing.

19. An abrasive perforator tool comprising:

a tubular tool housing comprising an inlet and an outlet and a sidewall extending therebetween, the sidewall defining a central bore extending between the inlet and the outlet;

at least one nozzle in the sidewall;

a sleeve assembly supported in the tool housing and operable to provide a first flow path, a second flow path, and a third flow path, wherein the sleeve assembly comprises first and second sleeves, wherein the first sleeve comprises a sidewall with an outer surface, and wherein the second flow path is defined in part by the outer surface of the first sleeve's sidewall;

wherein the first flow path directs fluid entering the inlet of the housing to bypass the at least one nozzle and to pass through the tool to the outlet of the housing;

wherein the second flow path directs fluid entering the inlet of the housing to pass through the at least one nozzle;

wherein the third flow path directs fluid entering the inlet of the housing to bypass the at least one nozzle and to pass through the tool to the outlet of the housing; and actuators for initiating operation of the sleeve assembly.

20. An abrasive perforator tool comprising:

a tubular tool housing comprising an inlet and an outlet and a sidewall extending therebetween, the sidewall defining a central bore extending between the inlet and the outlet;

at least one nozzle in the sidewall;

a sleeve assembly supported in the tool housing and operable to provide a first flow path, a second flow path, and a third flow path;

wherein the sidewall of the housing defines longitudinal flow channels that partly define the third flow path;

wherein the first flow path directs fluid entering the inlet of the housing to bypass the at least one nozzle and to pass through the tool to the outlet of the housing;

wherein the second flow path directs fluid entering the inlet of the housing to pass through the at least one nozzle;

wherein the third flow path directs fluid entering the inlet of the housing to bypass the at least one nozzle and to pass through the tool to the outlet of the housing; and actuators for initiating operation of the sleeve assembly.

21. An abrasive perforator tool comprising:

a tubular tool housing comprising an inlet and an outlet and a sidewall extending therebetween, the sidewall defining a central bore extending between the inlet and the outlet;

at least one nozzle in the sidewall;

a sleeve assembly supported in the tool housing and operable to provide a first flow path, a second flow path, and a third flow path;

wherein the first flow path directs fluid entering the inlet of the housing to bypass the at least one nozzle and to pass through the tool to the outlet of the housing;

wherein the second flow path directs fluid entering the inlet of the housing to pass through the at least one nozzle; and wherein the third flow path directs fluid entering the inlet of the housing to bypass the at least one nozzle and to pass through the tool to the outlet of the housing;

actuators for initiating operation of the sleeve assembly; and wherein the sleeve assembly comprises first and second sleeves, wherein each of the first and second sleeves is movable from a non-deployed position to a deployed position, wherein the first sleeve comprises an upper end member and a lower end member and a sleeve body therebetween, wherein the second sleeve comprises an upper end member and a lower end member and a sleeve body therebetween, wherein the lower end member of the second sleeve is detachably fixed to the housing, wherein the upper end member of the second sleeve includes a recess for receiving the upper end of the first sleeve when the first sleeve is undeployed to direct fluid from the inlet through the first sleeve, and wherein the first sleeve is positioned concentrically within the sleeve body forming an annular chamber that fluidly connects the inlet to the at least one nozzle when the first sleeve is deployed and the second sleeve is undeployed, the second sleeve having ports therein for allowing fluid to pass from the annular chamber to the at least one nozzle.

* * * * *